US009113242B2

(12) United States Patent
Hyun

(10) Patent No.: US 9,113,242 B2
(45) Date of Patent: Aug. 18, 2015

(54) SOUND SOURCE SIGNAL PROCESSING APPARATUS AND METHOD

(75) Inventor: Kyung Hak Hyun, Suwon-si (KR)

(73) Assignee: SAMSUNG ELECTRONICS CO., LTD. (KR)

( * ) Notice: Subject to any disclaimer, the term of this patent is extended or adjusted under 35 U.S.C. 154(b) by 734 days.

(21) Appl. No.: 13/275,801

(22) Filed: Oct. 18, 2011

(65) Prior Publication Data

US 2012/0114138 A1 May 10, 2012

(30) Foreign Application Priority Data

Nov. 9, 2010 (KR) ..... 10-2010-0110838

(51) Int. Cl.
*H04R 3/00* (2006.01)

(52) U.S. Cl.
CPC ..... *H04R 3/005* (2013.01); *H04R 2201/401* (2013.01); *H04R 2201/403* (2013.01)

(58) Field of Classification Search
CPC ..... H04R 3/005; H04R 2201/401; H04R 2201/403
See application file for complete search history.

(56) References Cited

U.S. PATENT DOCUMENTS

2004/0175005 A1* 9/2004 Roeck ..... 381/74
2004/0175006 A1* 9/2004 Kim et al. ..... 381/92
2011/0019836 A1* 1/2011 Ishibashi et al. ..... 381/92
2011/0082690 A1* 4/2011 Togami et al. ..... 704/201

FOREIGN PATENT DOCUMENTS

WO WO 2009119844 A1 * 10/2009

OTHER PUBLICATIONS

Displacement (vector), http://en.wikipedia.org/w/index.php?title=Displacement_%28vector%29&oldid=4857340, Jul. 26, 2004.*

* cited by examiner

*Primary Examiner* — Joseph Saunders, Jr.
(74) *Attorney, Agent, or Firm* — Harness, Dickey & Pierce PLC

(57) ABSTRACT

A sound source signal processing apparatus including a first sound source detection unit having at least one microphone to detect a sound source signal, a second sound source detection unit having at least one microphone to detect the sound source signal, the second sound source detection unit being spaced apart from the first sound source detection unit, and a beamforming unit to beamform the sound source signal detected by the first sound source detection unit and the second sound source detection unit. At least one microphone is further provided in addition to the microphone array, and position information of the microphones and sound source information are used, thereby improving beamforming performance of the sound source signal. Also, the number and size of microphone arrays is reduced through further provision of the at least one microphone, thereby improving spatial utilization.

23 Claims, 11 Drawing Sheets

(PRIOR ART) (EMBODIMENT )

(PRIOR ART) (EMBODIMENT)

(PRIOR ART) (EMBODIMENT)

SOUND SOURCE SIGNAL PROCESSING APPARATUS AND METHOD

CROSS-REFERENCE TO RELATED APPLICATIONS

This application claims the benefit of Korean Patent Application No. 10-2010-0110838, filed on Nov. 9, 2010 in the Korean Intellectual Property Office, the disclosure of which is incorporated herein by reference.

BACKGROUND

1. Field

Embodiments relate to a sound source signal processing apparatus and method that perform beamforming using a microphone array.

2. Description of the Related Art

Telephone communication, voice recording, or motion picture capturing using portable digital devices has been popularized.

Various digital devices, such as consumer electronics devices, portable phones, and digital camcorders, and in-car voice recognition apparatus use a microphone to acquire a voice.

An environment in which a sound source is recorded, or a voice signal is input through such digital devices, is often not quiet. Instead, the environment may often include various noises and surrounding interference sounds.

A microphone exhibiting high directivity, i.e., a unidirectional microphone, may be used or the distance between the microphone and a speaker may be decreased to better capture the voice of the speaker in such an environment. When the distance between the microphone and the speaker is increased, surrounding noises or reverberations as well as the voice of the speaker may enter the microphone, resulting in low signal-to-noise ratio (SNR).

For this reason, technology of a beamformer to form a beam in a specified direction using two or more microphone arranged in an array, instead of reducing the distance between the microphone and the speaker, has been developed.

The beamformer finds the direction of a sound using a time difference between signals reaching the respective microphones arranged in the array and intensifies only a voice signal located in the specified direction or removes unnecessary interference noise. In this case, at least two microphones are arranged in the array, and the positions of the respective microphones and the distance between the microphones are preset.

Using such beamformer technology, efficiency in sound separation or speaker localization to remove or separate a noise source from the speaker may be improved, and noise or reverberation having no directivity may be reduced through post filtering.

That is, voice signals from long distances are acquired using the microphone array to emphasize or suppress voice signals input in a specified direction and to remove sound in the other directions.

The beamformer serves as a spatial filter to filter only a signal in a specified spatial region. How much a beam width is formed in a direction in which the beamformer is directed is connected directly with the resolution performance of the beamformer. Here, the beam width is indicated as a half power beam width, at which approximately 3 dB is reduced in the directed direction. The beam width of a delay-and-sum beamformer is as follows.

$$HPBW_\theta \cong 2\sin^{-1}\left(\sqrt{\frac{3}{2}}\frac{c}{\pi N d f}\right)$$

Where, N indicates the number of microphones constituting the microphone array. The resolution performance is proportional to the size of the microphone array and frequency. That is, large size of the microphone array and high frequency of a target sound source provide high resolution performance. The distance d between the microphones constituting the microphone array may satisfy the following conditions to prevent spatial aliasing.

$$f_u = \frac{c}{2d},\ d \le \frac{c}{2f} = \frac{\lambda}{2}$$

Where, $\lambda$ indicates the wavelength of a signal, and c indicates the speed of the signal.

This is distinguished only when a phase difference caused by time delay between the neighboring microphones is $2\pi$ or less.

That is, when the size of the microphone array is not sufficiently large, the beamformer may not exhibit an effect with respect to a low frequency band signal.

In particular, the beamformer technology may be properly applied to a voice signal having a frequency of 1000 Hz or less. In this case, the number of the microphones in the microphone array may be increased. However, the increase in number of the microphones leads to the increase in manufacturing costs. Also, if the number of the microphones is increased, the size of the microphone array is increased with the result that an installation space may be insufficient.

SUMMARY

It is an aspect of an embodiment to provide a sound source signal processing apparatus that beamforms a sound source signal using a microphone array and at least one microphone and a control method thereof.

It is another aspect of an embodiment to provide a sound source signal processing apparatus that detects position information using a microphone array, at least one microphone and a position detection unit to detect the relative position between the microphone array and the at least one microphone and beamforms a sound source signal using the detected position information and a control method thereof.

Additional aspects of embodiments will be set forth in part in the description which follows and, in part, will be obvious from the description, or may be learned by practice of embodiments.

In accordance with an aspect of an embodiment, a sound source signal processing apparatus includes a first sound source detection unit having at least one microphone to detect a sound source signal, a second sound source detection unit having at least one microphone to detect the sound source signal, the second sound source detection unit being spaced apart from the first sound source detection unit, and a beamforming unit to beamform the sound source signal detected by the first sound source detection unit and the second sound source detection unit.

The beamforming unit may beamform the sound source signal using relative position information between the first sound source detection unit and the second sound source detection unit.

The relative position information between the first sound source detection unit and the second sound source detection unit may be preset.

The sound source signal processing apparatus may further include a position detection unit provided at the first sound source detection unit and the second sound source detection unit to detect the relative position between the first sound source detection unit and the second sound source detection unit.

The position detection unit may include a radio frequency (RF) transmitter and an RF receiver.

The position detection unit may include an ultrasonic transmitter and an ultrasonic receiver.

The position detection unit may include an infrared transmitter and an infrared receiver.

The relative position information may include a relative distance and angle between the first sound source detection unit and the second sound source detection unit.

The sound source signal processing apparatus may further include a sound pressure detection unit to detect sound pressure of the sound source signal and a controller to determine whether a voice signal is contained in the sound source signal by comparing the detected sound pressure level of the sound source signal with a reference sound pressure level and controls the sound source signal to be beamformed upon determining that the voice signal is contained in the sound source signal.

The controller may control the position detection unit to be periodically driven to acquire the relative position information between the first sound source detection unit and the second sound source detection unit during the beamforming.

The sound source signal processing apparatus may further include a direction input unit to allow a user to input direction information during the beamforming, and the beamforming unit may beamform the sound source signal reflecting the direction information input by the user.

In accordance with another aspect of an embodiment, a sound source signal processing method includes detecting sound source signals from different positions through first and second sound source detection units each having at least one microphone and beamforming the sound source signals based on position information between the sound source signals detected at the different positions.

Beamforming the sound source signals may include reflecting a weight in each of the sound source signals detected at the different positions and performing fast Fourier transform (FFT) with respect to the weighted sound source signals, summing the sound source signals with respect to which FFT has been performed, and performing inverse FFT with respect to the summed signal.

The position information between the sound source signals detected at the different positions may be preset.

The sound source signal processing method may further include transmitting a position signal through a transmitter installed adjacent to the second sound source detection unit upon detection of the sound source signals, receiving the position signal through a receiver installed adjacent to the first sound source detection unit, and acquiring relative position information between the sound source signals detected at the different positions based on the received position signal.

The sound source signal processing method may further include transmitting a position signal through a transmitter installed adjacent to the first sound source detection unit upon detection of the sound source signals, receiving the position signal through a receiver installed adjacent to the second sound source detection unit, and acquiring relative position information between the sound source signals detected at the different positions based on the received position signal.

The position signal may include an ultrasonic signal or an RF signal.

Beamforming the sound source signals may include beamforming the sound source signals based on direction information input by a user.

The sound source signal processing method may further include detecting a sound pressure level of each of the sound source signals, comparing the detected sound pressure level with a reference sound pressure level, determining that a voice signal is contained in each of the sound source signals when the detected sound pressure level is equal to or greater than the reference sound pressure level, and beamforming the sound source signals upon determining that the voice signal is contained in each of the sound source signals.

Beamforming the sound source signals may include confirming a frequency of each of the sound source signals, determining whether a voice signal is contained in each of the sound source signals based on the confirmed frequency, and beamforming the sound source signals upon determining that the voice signal is contained in each of the sound source signals.

BRIEF DESCRIPTION OF THE DRAWINGS

These and/or other aspects of embodiments will become apparent and more readily appreciated from the following description of the embodiments, taken in conjunction with the accompanying drawings of which.

DETAILED DESCRIPTION

Figure 1:
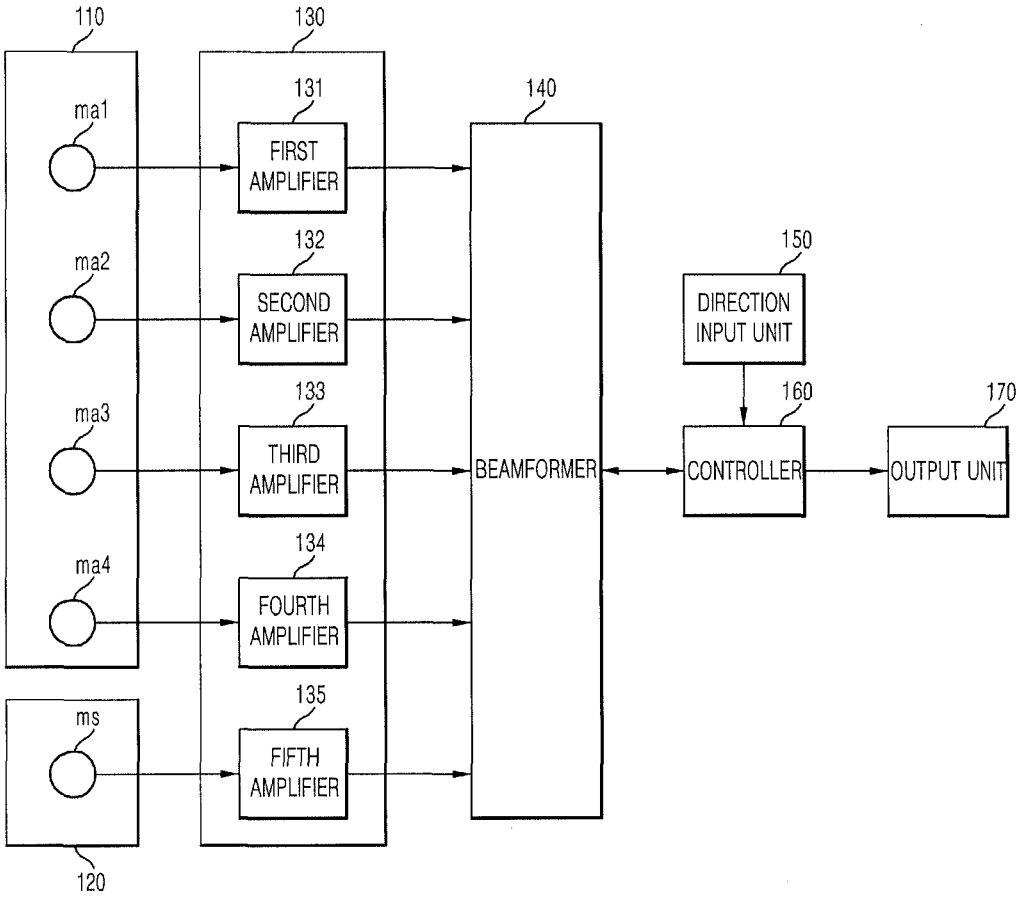
FIG. 1 is a construction view of a sound source signal processing apparatus according to an embodiment.

Reference will now be made in detail to embodiments, examples of which are illustrated in the accompanying drawings, wherein like reference numerals refer to like elements throughout.

FIG. 1 is a construction view of a sound source signal processing apparatus according to an embodiment. The sound source signal processing apparatus includes a first sound source detection unit 110, a second sound source detection unit 120, a sound source amplification unit 130, a beamforming unit 140, a direction input unit 150, a controller 160, and an output unit 170.

The first sound source detection unit 110 is fixedly installed in a region, such as a terminal or a conference room, where a sound source is to be detected.

The first sound source detection unit 110 includes a microphone array, which detects a sound wave from a sound source and generates an electrical signal corresponding to the sound wave. The electrical signal will be referred to as a sound source signal.

The microphone array includes a plurality of microphones ma1 to ma4. The microphones ma1 to ma4 are arranged in a straight line at uniform or nonuniform intervals. The intervals of the microphones are preset and stored.

The microphone array may include at least one microphone.

The second sound source detection unit 120 is spaced apart from the first sound source detection unit 110 and is installed at a position different from the position where the first sound source detection unit 110 is installed. The second sound source detection unit 120 is fixedly installed in the same region as the first sound source detection unit 110 so that the second sound source detection unit 120 is spaced apart from the first sound source detection unit 110. Relative position information between the second sound source detection unit 120 and the first sound source detection unit 110 is preset and stored.

The relative position information between the second sound source detection unit 120 and the first sound source detection unit 110 includes the relative distance and angle between the second sound source detection unit 120 and a point of the first sound source detection unit 110. The point of the first sound source detection unit 110 may be the middle of the first sound source detection unit 110 in the straight line.

The second sound source detection unit 120 includes at least one microphone ms, which detects a sound wave from a sound source and generates an electrical signal corresponding to the sound wave. The electrical signal will be referred to as a sound source signal.

The sound source amplification unit 130 includes a plurality of amplifiers. Specifically, the sound source amplification unit 130 includes a first amplifier 131, a second amplifier 132, a third amplifier 133, and a fourth amplifier 134 connected to the microphones ma1 to ma4 of the first sound source detection unit 110, respectively, and a fifth amplifier 135 connected to the microphone ms of the second sound source detection unit 120.

The first amplifier 131, the second amplifier 132, the third amplifier 133, and the fourth amplifier 134 of the sound source amplification unit 130 amplify sound source signals received from the microphones ma1 to ma4 of the first sound source detection unit 110, respectively, and the fifth amplifier 135 amplifies a sound source signal received from the microphone ms of the second sound source detection unit 120.

The beamforming unit 140 changes weights of the microphones of the first sound source detection unit 110 and the second sound source detection unit 120 to beamform the sound source signals so that only the sound source signals existing in the target direction are selectively output and the sound source signals existing in the other directions are removed.

The beamforming unit 140 includes a plurality of buffers to store sound source signals Xn(t) received from the sound source amplification unit 130, a plurality of fast Fourier transformers to perform fast Fourier transform (FFT) per microphone with respect to the sound source signals Xn(t) output from the buffers to resolve the signals per frequency, a calculator to reflect weights corresponding to the respective frequencies in the signals transformed by the fast Fourier transformers and to add the signals, and an inverse fast Fourier transformer to perform inverse FFT with respect to the signals received from the calculator.

If a user inputs a certain direction, i.e., a beamforming direction, the beamforming unit 140 compensates sound source signals detected in the input direction for a time difference and performs FFT.

The beamforming unit 140 may selectively output only sound source signals in a direction in which a voice signal is present and remove sound source signals in directions in which the voice signal is not present.

Here, the voice signal is a broadband signal. The beamforming unit 140 stores a sound source signal per microphone for a predetermined period of time and performs FFT with respect to the stored sound source signals. Also, the beamforming unit 140 performs narrowband beamforming per frequency and inverse FFT. In this way, the beamforming unit 140 performs beamforming. Consequently, noise detected in directions different from the direction of the sound source including the voice signal may be removed using directivity of the sound source.

That is, the beamforming unit 140 selects and outputs only the sound source signals in the direction in which the voice signal is present (or in the direction input by the user) and removes the sound source signals in the other directions among the sound source signals detected by the microphones of the first sound source detection unit 110 and the second sound source detection unit 120.

The beamforming unit 140 will be described later with reference to FIGS. 2A to 2C.

The direction input unit 150 allows a user to input a certain direction and transmits information on the input direction to the controller 160. Here, the certain direction is a direction to be oriented during beamforming.

The controller 160 determines whether a specified signal is contained in the sound source detected by the first sound source detection unit 110. Upon determining that the specified signal is contained in the sound source, the controller 160 controls the operation of the beamforming unit 140.

Here, the specified signal may be a voice signal. That is, determination of the voice signal is to determine a sound signal having a sound pressure level of 0 to 130 dB within a frequency range of 20 to 20000 Hz, i.e., the audible range.

When information on a certain direction is input through the direction input unit 150, the controller 160 transmits the input direction information to the beamforming unit 140. Consequently, only a sound signal detected in the certain direction input by the user may be filtered.

The controller 160 controls the operation of the output unit 170 so that the sound source signal beamformed by the beamforming unit 140 is output through the output unit 170.

The output unit 170 converts the sound source signal corresponding to inverse FFT into vibration of a vibration plate and outputs a sound wave to the air according to a control command from the controller 160.

In case of outputting a voice signal, the output unit 170 converts the voice signal corresponding to inverse FFT into vibration of the vibration plate to generate a longitudinal wave and outputs a sound wave.

The output unit 170 may include a speaker.

Figure 2A:
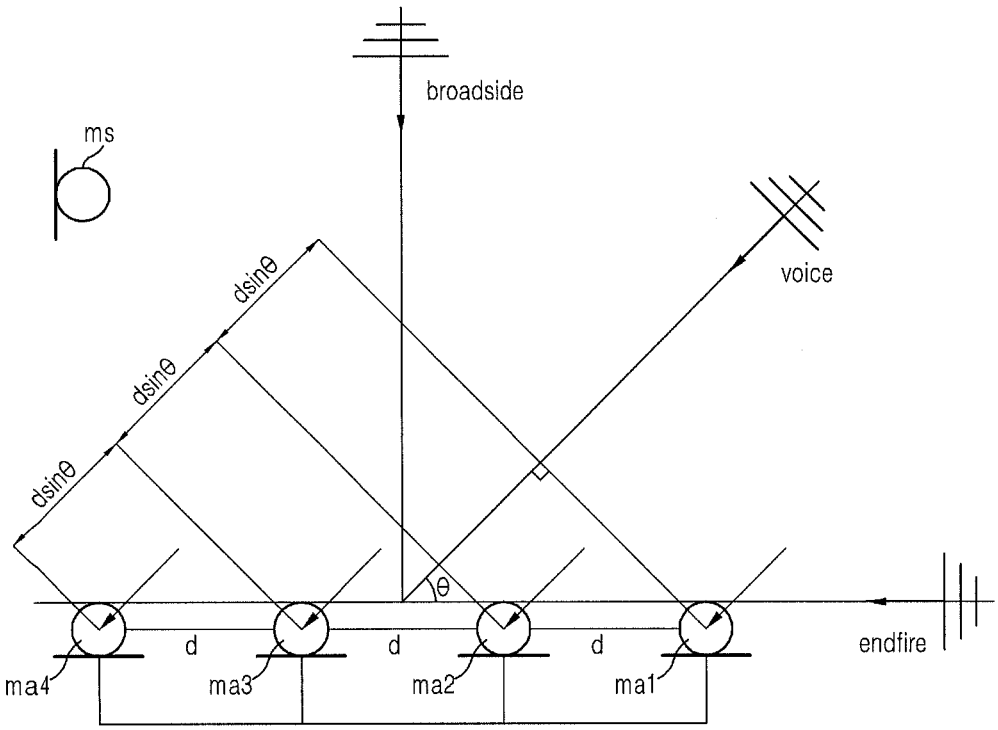
FIGS. 2A to 2C are views illustrating beamforming of the sound source signal processing apparatus of FIG. 1.
Figure 2B:
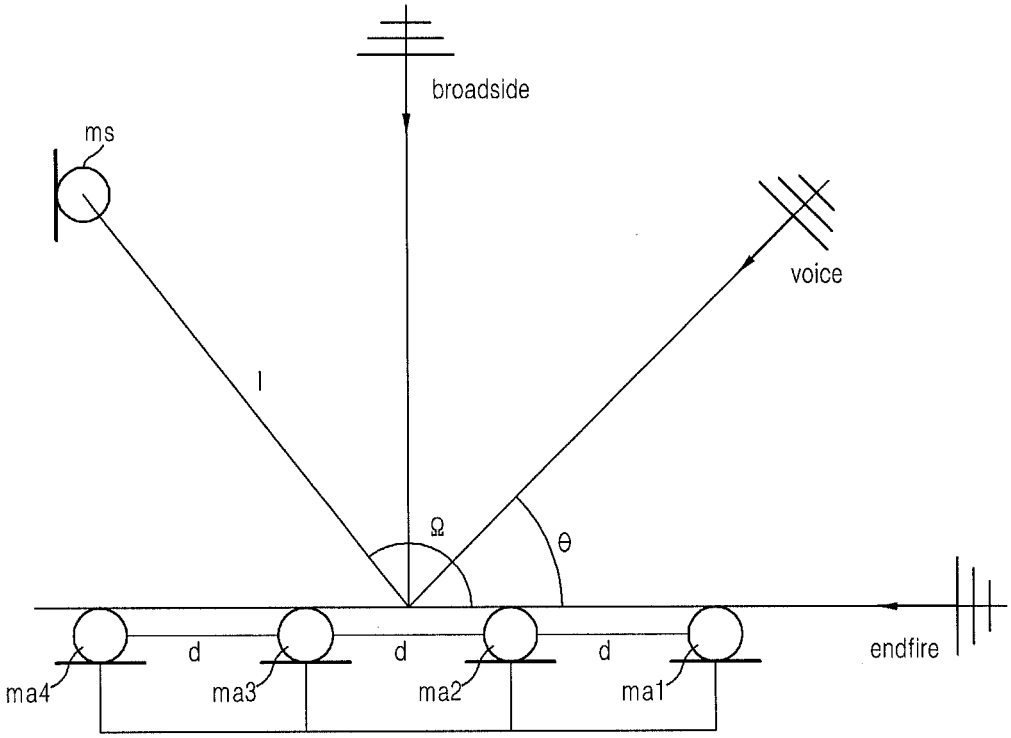
Figure 2C:
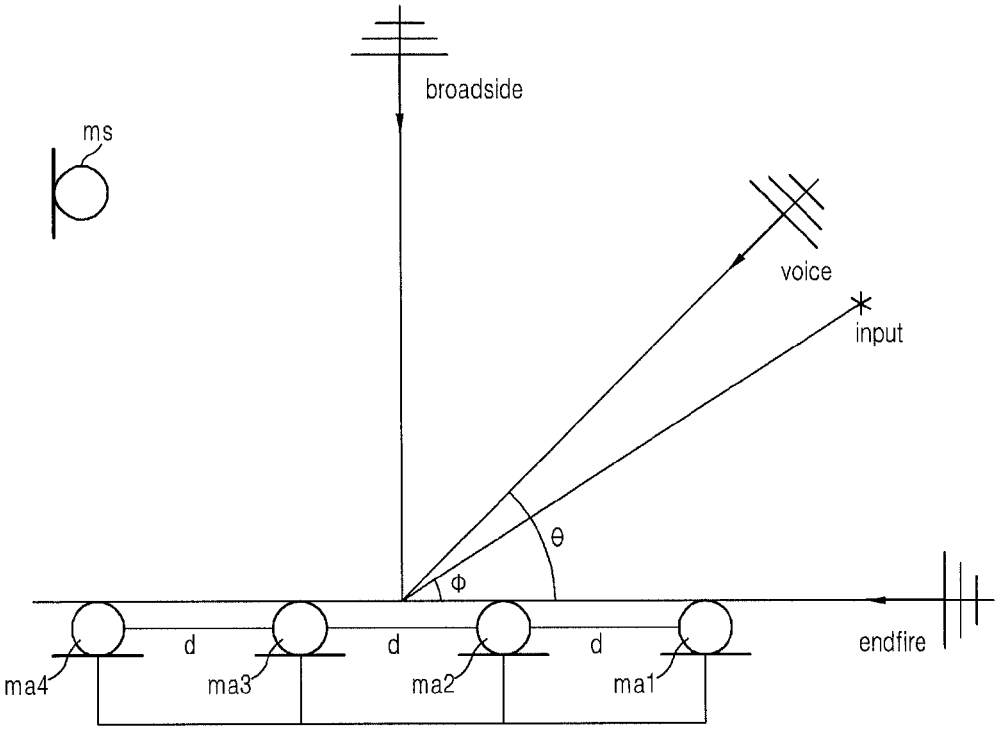

FIGS. 2A to 2C are views illustrating beamforming of the sound source signal processing apparatus of FIG. 1.

As shown in FIG. 2A, the first sound source detection unit 110 has a linear microphone array including a plurality of microphones ma1 to ma4 arranged at uniform intervals, and the second sound source detection unit 120 has at least one microphone (hereinafter, referred to as a single microphone) ms spaced apart from the linear microphone array.

On the assumption that a sound source is generated from a distance longer than the size of the microphone array, signals reaching the respective microphones ma1 to ma4 of the microphone array are planar waves.

Sound source signals of the planar waves reaching the respective microphones ma1 to ma4 of the microphone array and the signal microphone ms have different time delay based on the position of the microphones.

When the distance between neighboring microphones is d, the speed of a sound source signal is c, and a sound source direction to the microphone array is θ, as shown in FIG. 2A, the sound source signal between the neighboring microphones has a time delay of $$\frac{nd\sin\theta}{c}.$$

On the assumption that a sound source signal directed to a reference microphone (here, a first microphone ma1) is $x_0$ and time during which the sound source signal reaches the first microphone ma1 is t, a sound source signal $x_n(t)$ resulting from compensation for the difference in arrival time between the microphones is output as follows.

$$x_n(t) = t - \frac{nd\sin\theta}{c}$$

Next, the result of beamforming performed reflecting the sound source signal $x_n(t)$ per microphone of the microphone array and a weight w per microphone is as follows.

$$y_a(t) = \sum_{n=0}^{N-1} \omega_n x_n(t) = \sum_{n=0}^{N-1} \omega_n x_0\left(t - \frac{nd\sin\theta}{c}\right)$$

This uses a delay-and-sum beamformer.

FFT is performed with respect thereto as follows.

$$Y_a(f) = \sum_{n=0}^{N-1} w_n X_a(f)\exp\left(-2\pi j\frac{nd\sin\theta}{c}\right)$$

Consequently, frequency response to the beamforming is as follows.

$$H_a(f) = \sum_{n=0}^{N-1} w_n \exp\left(-2\pi j\frac{nd\sin\theta}{c}\right)$$

On the assumption that the distance and angle between the middle of the microphone array of the first sound source detection unit 110 and the single microphone of the second sound source detection unit 120 is I and Ω, the speed of a sound source signal is c, and a sound source direction to the microphone array is θ, as shown in FIG. 2B, the sound source signal reaches the single microphone later, by a time delay of $$\frac{l\sin(\theta - \Omega)}{c},$$

than the middle of the microphone array.

On the assumption that a sound source signal directed to a reference microphone (here, a first microphone ma1) is $x_0$ and time during which the sound source signal reaches the first microphone ma1 is t, a sound source signal $x_s(t)$ of the single microphone ms resulting from compensation for the difference in arrival time between the microphones is output as follows.

$$x_s(t) = x_0\left(t - \frac{l\sin(\theta - \Omega)}{c}\right)$$

Next, the result of beamforming performed reflecting the sound source signal $x_s(t)$ of the single microphone ms and a weight w' of the single microphone ms is as follows.

$$y_s(t) = \omega' x_0\left(t - \frac{l\sin(\theta - \Omega)}{c}\right)$$

FFT is performed with respect thereto as follows.

$$Y_s(f) = \omega' X_s(f)\exp\left(-2\pi j\frac{l\sin(\theta - \Omega)}{c}\right)$$

Consequently, frequency response to the beamforming is as follows.

$$H_s(f) = w'\exp\left(-2\pi j\frac{l\sin(\theta - \Omega)}{c}\right)$$

That is, frequency response to the sound source signal of the microphone array of the first sound source detection unit 110 and to the sound source signal of the single microphone of the second sound source detection unit 120 is as follows.

$$H(f) = H_a(f) + H_s(f)$$

$$H(f) = \sum_{n=0}^{N-1} w_n \exp\left(-2\pi j\frac{nd\sin\theta}{c}\right) + w'\exp\left(-2\pi j\frac{l\sin(\theta - \Omega)}{c}\right)$$

That is, the sound source signal processing apparatus outputs a signal corresponding to H(f) as the result of the beamforming performed by the beamformer 140.

When it is designed to filter only a sound source signal generated in a certain direction ϕ input by a user, a time difference of $$\frac{nd\sin\phi}{c}$$

is compensated with respect to a sound source signals entering each microphone. Consequently, a sound signal $x_n(t)$ for each of the microphones ma1 to ma4 of the microphone array is output as follows.

$$x_n(t) = t - \frac{nd(\sin\theta - \sin\phi)}{c}$$

Next, the result of beamforming performed reflecting the sound source signal $x_n(t)$ for each of the microphones ma1 to ma4 of the microphone array and a weight w per microphone is as follows.

$$y_a(t) = \sum_{n=0}^{N-1} \omega_n x_n(t) = \sum_{n=0}^{N-1} \omega_n x_0\left(t - \frac{nd(\sin\theta - \sin\phi)}{c}\right)$$

FFT is performed with respect thereto as follows.

$$Y_a(f) = \sum_{n=0}^{N-1} w_n X_a(f)\exp\left(-2\pi j\frac{nd(\sin\theta - \sin\phi)}{c}\right)$$

Consequently, frequency response to the beamforming is as follows.

$$H_a(f) = \sum_{n=0}^{N-1} w_n \exp\left(-2\pi j\frac{nd(\sin\theta - \sin\phi)}{c}\right)$$

Frequency response obtained by processing the sound source signals of the microphone array of the first sound source detection unit 110 and of the single microphone of the second sound source detection unit 120 is as follows.

$$H(f) = H_a(f) + H_s(f)$$

$$H(f) = \sum_{n=0}^{N-1} w_n \exp\left(-2\pi j\frac{nd(\sin\theta - \sin\phi)}{c}\right) + w'\exp\left(-2\pi j\frac{l(\sin(\theta - \Omega) - \sin(\phi - \Omega)}{c}\right)$$

That is, the sound source signal processing apparatus outputs a signal corresponding to H(f) as the result of the beamforming performed by the beamformer 140.

When the single microphone is further provided so that the single microphone is spaced apart from the microphone array including N microphones, as described above, the total size of the microphones is increased, thereby improving resolution performance and improving a beamforming effect with respect to a low frequency band signal.

In particular for a voice signal, beamforming is effectively performed at a frequency of 1,000 Hz or less.

This is because the resolution performance is proportional to the size of the microphone array and the frequency.

As a result, the size of the microphones is increased without increasing the number of the microphones of the microphone array or the intervals of the microphones, thereby reducing manufacturing costs of the microphone array and effectively utilizing a space where the microphone array is installed.

Figure 3:
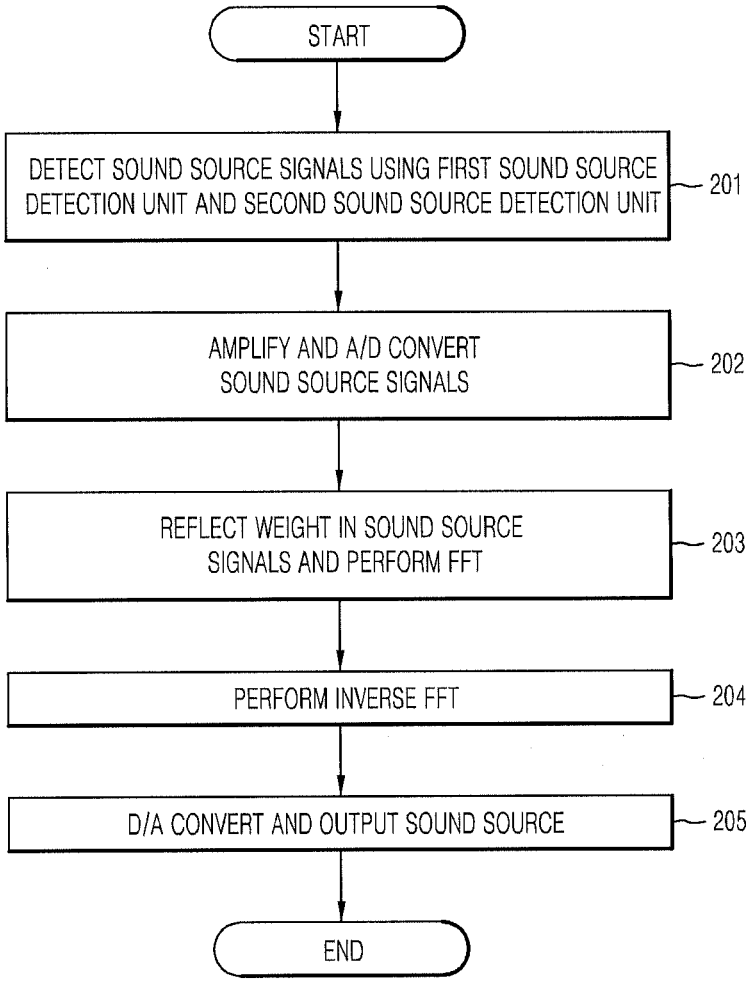
FIG. 3 is a control flow chart of the sound source signal processing apparatus of FIG. 1.

FIG. 3 is a control flow chart of the sound source signal processing apparatus of FIG. 1.

A sound source is detected using the microphone array of the first sound source detection unit 110 and the microphone ms of the second sound source detection unit 120 (201). Sound source signals detected by the respective microphones ma1 to ma4 and ms are amplified by the sound source amplification unit 130 (131 to 135), and the amplified sound source signals, which are analog signals, are converted into digital signals (202).

Subsequently, the sound source signal processing apparatus performs beamforming using the relative position information, i.e., the distance I and the angle Ω, between the microphone array of the first sound source detection unit 110 and the microphone ms of the second sound source detection unit 120 and information on the predetermined distance d between the neighboring ones of the microphones ma1 to ma4 of the microphone array.

The beamforming will be described in more detail.

The sound source signal processing apparatus stores the sound source signals detected by the respective microphones ma1 to ma4 and ms for a predetermined period of time, sums the sound source signals reflecting a weight in the sound source signal for each of the microphones ma1 to ma4 and ms, and performs FFT with respect to the summed signal (223).

Subsequently, the sound source signal processing apparatus resolves the signal, with respect to which FFT has been performed, per frequency and performs inverse FFT (204).

At this time, the sound source signal processing apparatus may divide the sound source signal per frequency, applies a weight to the divided sound source signals, and sums the weighted sound source signals. As a result, an independent beam may be obtained using only frequencies of a voice signal.

Subsequently, the sound source signal processing apparatus converts a signal, which is a digital signal, corresponding to the inverse FFT into an analog signal and outputs the sound source converted into the analog signal (205).

Figure 4A:
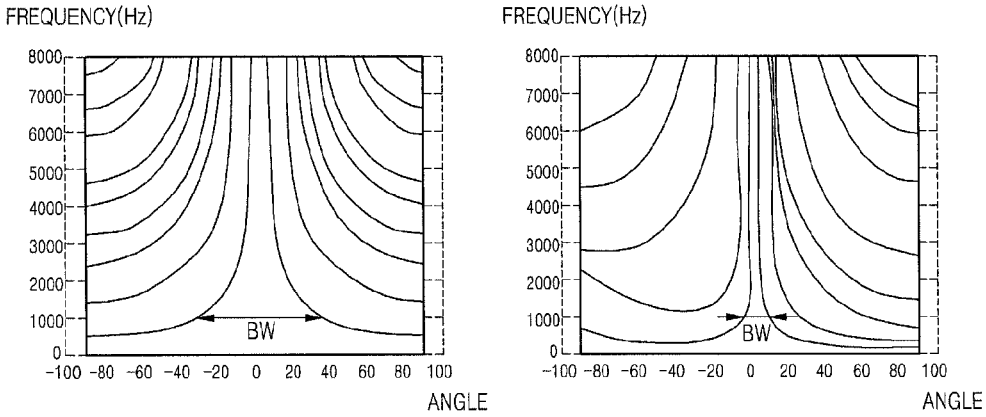
FIGS. 4A to 4C are views illustrating beam patterns of the sound source signal processing apparatus of FIG. 1.
Figure 4B:
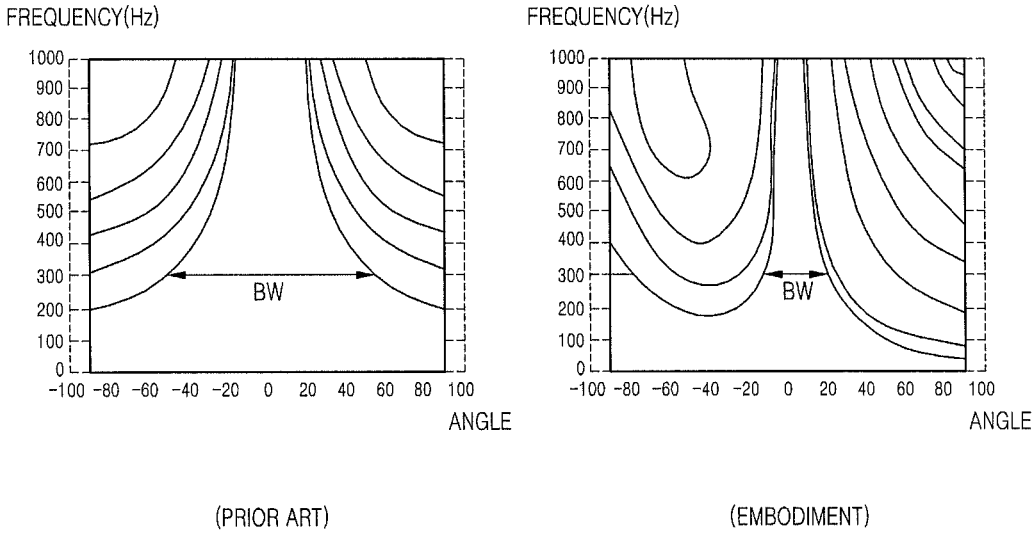
Figure 4C:
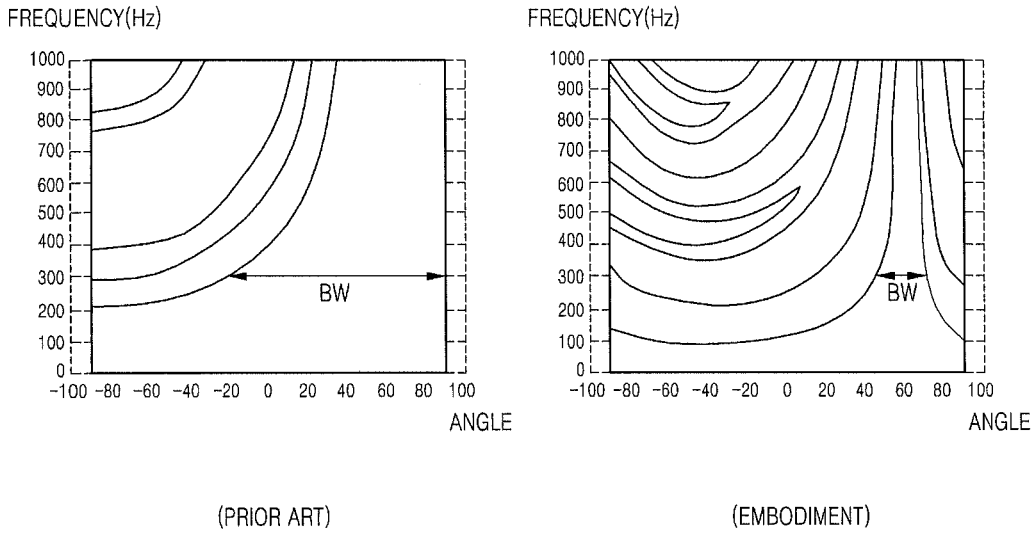

FIGS. 4A to 4C are views illustrating beam patterns of the sound source signal processing apparatus of FIG. 1.

The left side of FIG. 4A illustrates a beam pattern having a frequency of 8000 Hz or less during beamforming of a sound source signal processing apparatus of prior art, and the right side of FIG. 4A illustrates a beam pattern having a frequency of 8000 Hz or less during beamforming of the sound source signal processing apparatus of FIG. 1.

Beam patterns at the left and right sides of FIG. 4B are obtained by magnifying beam patterns having a low frequency, i.e., a frequency of 1000 Hz or less among the beam patterns at the left and right sides of FIG. 4A.

The left side of FIG. 4C illustrates a beam pattern having a frequency of 1000 Hz or less during beamforming of the sound source signal processing apparatus of prior art, and the right side of FIG. 4C illustrates a beam pattern having a frequency of 1000 Hz or less during beamforming of the sound source signal processing apparatus of FIG. 1. FIG. 4C illustrates beam patterns of a sound source signal having a beamforming direction angle input by a user of 60 degrees.

In the beam patterns illustrated in the left and right sides of FIGS. 4A to 4C, the inventive beam patterns have narrower beam widths than the beam patterns of prior art.

In particular, at a low frequency band of 1 KHz or less, as shown in FIG. 4B, the beam width of the inventive beam pattern is much narrower than the beam pattern of prior art.

Also, as shown in FIG. 4C, the beam width of the inventive beam pattern is much narrower than the beam pattern of prior art at opposite ends.

Consequently, the resolution performance of a spatial filter is improved, and therefore, separation between directive noise and a voice signal is effectively achieved. This is because the resolution performance of the spatial filter is improved in proportion to narrowness of the beam width of the beam pattern.

That is, the sound source signal processing apparatus may effectively maintain resolution performance at a low frequency band. Also, the sound source signal processing apparatus may maintain an important low frequency band signal without post-filtering.

Figure 5:
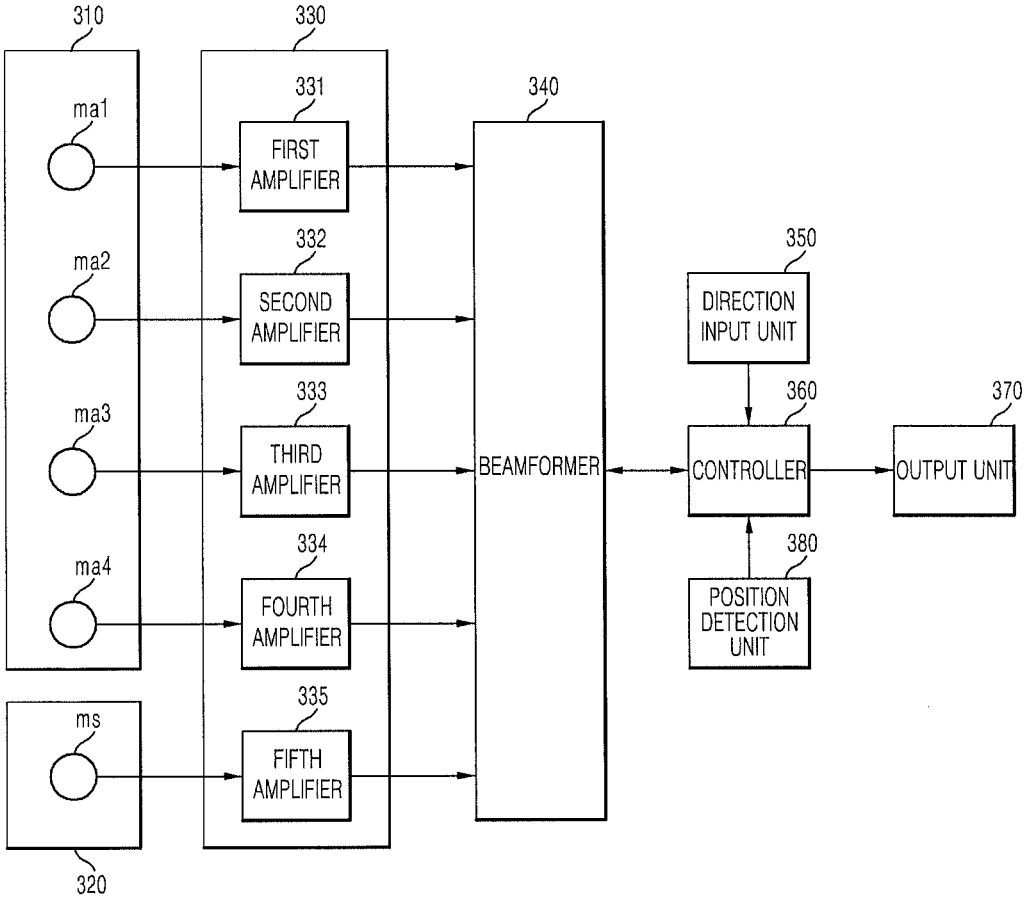
FIG. 5 is a construction view of a sound source signal processing apparatus according to another embodiment.
Figure 6:
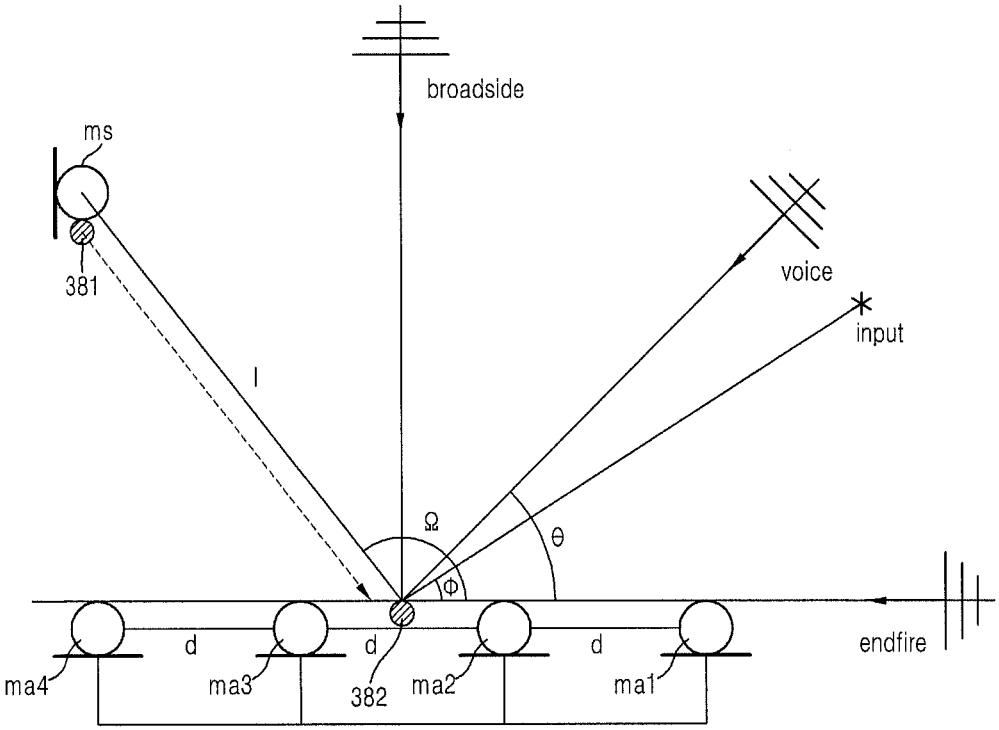
FIG. 6 is a view illustrating beamforming of the sound source signal processing apparatus of FIG. 5.

FIG. 5 is a construction view of a sound source signal processing apparatus according to another embodiment, and FIG. 6 is a view illustrating beamforming of the sound source signal processing apparatus of FIG. 5.

As shown in FIG. 5, the sound source signal processing apparatus includes a first sound source detection unit 310, a second sound source detection unit 320, a sound source amplification unit 330, a beamforming unit 340, a direction input unit 350, a controller 360, an output unit 370, and a position detection unit 380.

The sound source amplification unit 330, the beamforming unit 340, the direction input unit 350, and the output unit 370 are identical in construction to the sound source amplification unit 130, the beamforming unit 140, the direction input unit 150, and the output unit 170 as shown in FIG. 1, and therefore, a description thereof will not be given.

The first sound source detection unit 310 is fixedly installed in a region, such as a terminal or a conference room, where a sound source is to be detected.

The first sound source detection unit 310 includes a microphone array, which detects a sound wave from a sound source and generates an electrical signal corresponding to the sound wave. The electrical signal will be referred to as a sound source signal.

The microphone array includes a plurality of microphones ma1 to ma4. The microphones ma1 to ma4 are arranged in a straight line at uniform or nonuniform intervals. The intervals of the microphones are preset and stored.

The microphone array may include at least one microphone.

The second sound source detection unit 320 is spaced apart from the first sound source detection unit 310 and is installed at a position different from the position where the first sound source detection unit 310 is installed. The second sound source detection unit 320 is fixedly installed in the same region as the first sound source detection unit 310 so that the second sound source detection unit 320 is spaced apart from the first sound source detection unit 310. The second sound source detection unit 320 is movable.

Relative position information between the second sound source detection unit 320 and the first sound source detection unit 310 includes the relative distance and angle between the second sound source detection unit 320 and a point of the first sound source detection unit 310. The point of the first sound source detection unit 310 may be the middle of the first sound source detection unit 310 in the straight line.

The second sound source detection unit 320 includes at least one microphone ms, which detects a sound wave from a sound source and generates an electrical signal corresponding to the sound wave. The electrical signal will be referred to as a sound source signal.

The controller 360 determines whether a voice signal is contained in a sound source signal detected by at least one of the microphones ma1 to ma4 and ms. Upon determining that the voice signal is contained in the sound source signal, the controller 360 controls a transmitter 381 of the position detection unit 380 to be driven. Also, the controller 360 determines the relative position between the microphone array of the first sound source detection unit 310 and the microphone of the second sound source detection unit 320 based on a signal received by a receiver 382 of the position detection unit 380.

Here, determination as to whether the voice signal is present is to determine whether a component having an audible frequency of 20 to 20000 Hz is contained in the detected sound source signal.

Also, the relative position between the microphone array of the first sound source detection unit 310 and the microphone of the second sound source detection unit 320 is a relative distance I and angle Ω between the middle of the microphone array of the first sound source detection unit 310 and the microphone of the second sound source detection unit 320.

Here, a reference sound pressure is a sound pressure of approximately 0 to 130 dB, which is audible.

Also, a specified signal input by a user may be detected and beamformed in addition to the voice signal.

Upon determining that the voice signal is present, the controller 360 transmits the relative position information between the microphone array of the first sound source detection unit 310 and the microphone ms of the second sound source detection unit 320 and controls the operation of the beamformer 340 so that the voice signal is beamformed based on the relative position between the microphone array of the first sound source detection unit 310 and the microphone of the second sound source detection unit 320.

The controller 360 may control a sound pressure detection unit (not shown) to detect sound pressure. Upon receipt of a sound pressure level signal detected by the sound pressure detection unit, the controller 360 may compare the detected sound pressure level with a reference sound pressure level. Upon determining that the detected sound pressure level is equal to or greater than the reference sound pressure level, the controller 360 may control the operation of the beamformer 340.

When information on a certain direction is input through the direction input unit 350, the controller 360 transmits the information on the input direction to the beamformer 140. Consequently, only the voice signal detected in a certain direction input by a user may be filtered.

The controller 360 controls the operation of the output unit 370 so that the voice signal beamformed by the beamformer 340 is output through the output unit 370.

The position detection unit 380 includes a transmitter 381 and a receiver 382.

As shown in FIG. 6, the transmitter 381 of the position detection unit 380 is installed adjacent to the microphone ms of the second sound source detection unit 320, and the receiver 382 of the position detection unit 380 is installed adjacent to the microphone array ma1 to ma4 of the first sound source detection unit 310.

Alternatively, the transmitter 381 of the position detection unit 380 may be installed adjacent to the microphone array ma1 to ma4 of the first sound source detection unit 310, and the receiver 382 of the position detection unit 380 may be installed adjacent to the microphone ms of the second sound source detection unit 320.

Also, the receiver 382 of the position detection unit 380 may be disposed at the middle of the microphone array of the first sound source detection unit 310 in a straight line.

The transmitter 381 of the position detection unit 380 transmits a position signal according to a command from the controller 360. The receiver 382 of the position detection unit 380 receives the position signal transmitted from the transmitter 381 and transmits the received position signal to the controller 360.

The transmitter 381 of the position detection unit 380 may include an ultrasonic oscillator, and the receiver 382 of the position detection unit 380 may include an ultrasonic receiver. In this case, the controller 360 determines the relative position between the first and second sound source detection units 310 and 320 based on arrival time of ultrasonic waves.

Also, the transmitter 381 of the position detection unit 380 may include a radio frequency (RF) oscillator, and the receiver 382 of the position detection unit 380 may include an RF receiver. In this case, the controller 360 determines the relative position between the first and second sound source detection units 310 and 320 based on arrival time of an RF signal.

In addition, the transmitter 381 of the position detection unit 380 may include an infrared emitter, and the receiver 382 of the position detection unit 380 may include an infrared receiver. In this case, the controller 360 determines the relative position between the first and second sound source detection units 310 and 320 based on the intensity of radiation.

Figure 7:
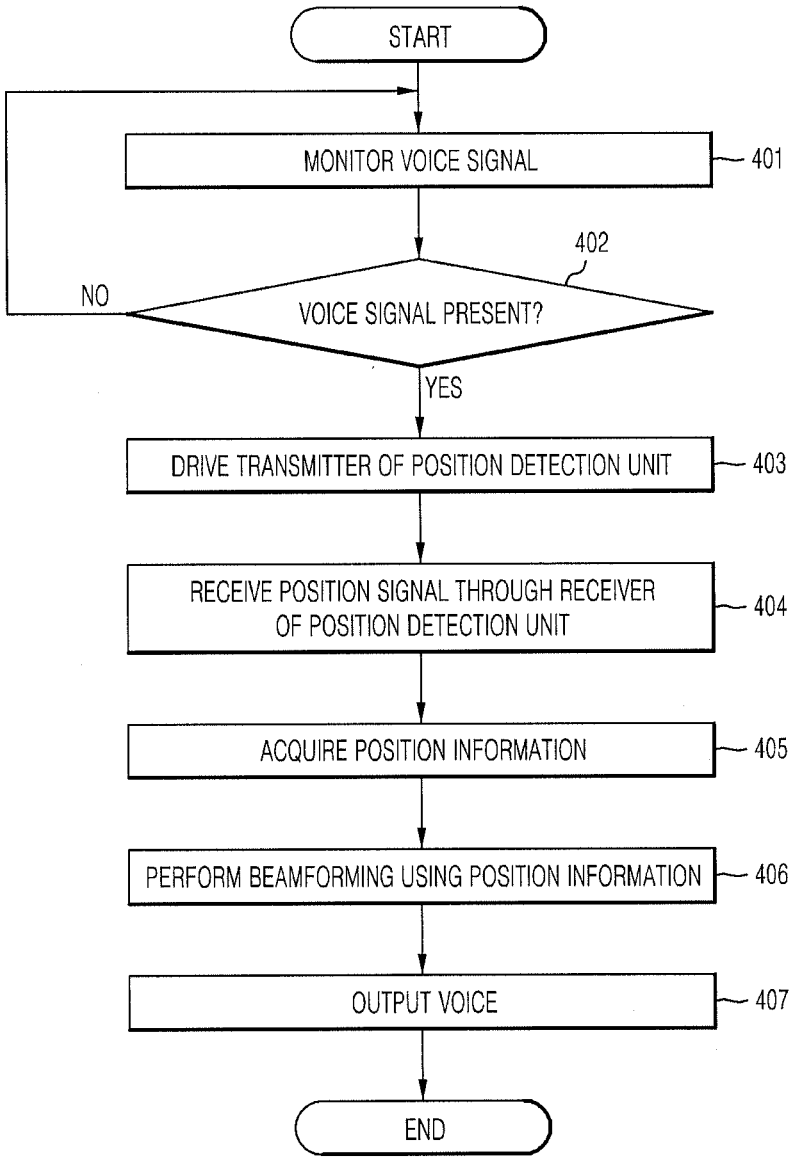
FIG. 7 is a control flow chart of the sound source signal processing apparatus of FIG. 5.

FIG. 7 is a control flow chart of the sound source signal processing apparatus of FIG. 5. Hereinafter, beamforming and outputting of a voice signal will be described as an example.

In an idle state, the sound source signal processing apparatus detects a sound pressure level of a sound source signal generated in a sound source detection region and determines whether the detected sound pressure level is equal to or greater than a reference sound pressure level to monitor whether a voice signal is present in the sound source signal in the sound source detection region (401).

Here, the reference sound pressure level is a sound pressure level (SPL) for voice determination.

Upon detection of a sound source having a sound pressure level less than the reference sound pressure level, the sound source signal processing apparatus determines that the voice signal is not present, and, upon detection of a sound source having a sound pressure level equal to or greater than the reference sound pressure level, the sound source signal processing apparatus determines that the voice signal is present (402).

In addition, determination as to whether the voice signal is present may be performed based on the frequency of the sound source signal.

Upon determining that the voice signal is present, the transmitter 381 of the position detection unit 380 installed adjacent to the microphone ms of the second sound source detection unit 320 is driven (403) to transmit a position signal.

When the receiver 392 of the position detection unit 380 installed adjacent to the microphone array of the first sound source detection unit 310 receives the position signal from the transmitter 381 (404), the received position signal is transmitted to the controller 360.

Here, the signal may be an RF or ultrasonic signal. In addition, the signal may be an infrared signal.

Subsequently, the controller 360 of the sound source signal processing apparatus acquires the relative position information, i.e., the distance I and the angle Ω, between the middle of the microphone array of the first sound source detection unit 310 and the microphone ms of the second sound source detection unit 320 based on the received signal and transmits the acquired position information to the beamformer 340.

Subsequently, the sound source signal processing apparatus detects sound source signals using the microphone array of the first sound source detection unit 310 and the microphone ms of the second sound source detection unit 320, amplifies the detected sound source signals using the sound source amplification unit 330 (331 to 335), and converts the amplified sound source signals, which are analog signals, into digital signals.

Subsequently, the sound source signal processing apparatus performs beamforming using the relative position information, i.e., the distance I and the angle Ω, between the microphone array of the first sound source detection unit 310 and the microphone ms of the second sound source detection unit 320 and information on the predetermined distance d between the neighboring ones of the microphones ma1 to ma4 of the microphone array of the first sound source detection unit 310 (406).

Subsequently, the sound source signal processing apparatus emphasizes a voice signal from the beamformed sound source signal and outputs the emphasized voice signal through the output unit 370 (407).

During generation of the sound source, the position of the second sound source detection unit 320 may be changed. Consequently, the operations of the transmitter 381 and the receiver 382 of the position detection unit 380 are periodically controlled to acquire position information on the second sound source detection unit 320 and the first sound source detection unit 310 and to perform beamforming based on the acquired information.

In a case in which the position of the second sound source detection unit 320 is not recognized from the signal received by the receiver 382 of the position detection unit 380, beamforming is independently performed by only the microphone array of the first sound source detection unit 310.

As is apparent from the above description, at least one microphone may be further provided in addition to the microphone array, and position information of the microphones and sound source information are used, thereby improving beamforming performance of a sound source signal.

Also, at least one microphone may be fixedly or movably installed, thereby achieving easy installation of the microphone.

In a case in which at least one microphone is movably installed, an RF or ultrasonic signal may be used to recognize relative position information between the microphone array and the at least one microphone.

The size of the microphone array may be rapidly increased based on the position of at least one microphone, thereby maximizing a spatial filtering effect even at a low frequency band and effectively chasing voice recognition and the position of a low frequency band sound source.

At least one microphone may be further provided to reduce the number and size of the microphone arrays, thereby improving spatial utilization.

Also, the number of the microphones may be reduced, thereby greatly reducing manufacturing costs.

Therefore, according to an embodiment, an array of microphones detects a sound source signal. A respective microphone, separate from the array, detects the sound source signal. A beamforming unit beamforms the sound source signal detected by the array and the sound signal detected by the respective microphone.

Accordingly, according to an embodiment, the array may be enclosed in an enclosure. For example, in FIG. 1, the first sound source detection unit 110, including the array of microphones ma1, ma2, ma3 and ma4, may be enclosed in an enclosure represented by the box shown in the figure defining the first sound source detection unit 110. The respective microphone ms in the second sound source detection unit 120 is outside of the enclosure. Similarly, for example, in FIG. 5, the first sound source detection unit 310, including the array of microphones ma1, ma2, ma3 and ma4, may be enclosed in an enclosure represented by the box shown in the figure defining the first sound source detection unit 310. The respective microphone ms in the second sound source detection unit 320 is outside of the enclosure.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A sound source signal processing apparatus, comprising:

a first sound source detection unit having at least one microphone configured to detect a sound source signal;

a second sound source detection unit having a single microphone configured to detect the sound source signal; and a beamforming unit configured to beamform the sound source signal detected by the first sound source detection unit and the single microphone of the second sound source detection unit based on a relative position between the first sound source detection unit and the single microphone of the second sound source detection unit;

wherein the relative position comprises a distance and angle between a center of the first sound source detection unit and the single microphone of the second sound source detection unit.

2. The sound source signal processing apparatus according to claim 1, wherein the relative position between the first sound source detection unit and the single microphone of the second sound source detection unit is preset.

3. The sound source signal processing apparatus according to claim 1, further comprising:

a position detection unit, provided at the first sound source detection unit and the single microphone of the second sound source detection unit, configured to detect the relative position between the first sound source detection unit and the single microphone of the second sound source detection unit.

4. The sound source signal processing apparatus according to claim 3, wherein the position detection unit comprises a radio frequency (RF) transmitter configured to transmit an RF signal and an RF receiver configured to receive the transmitted RF signal, and wherein the position detection unit is configured to detect the relative position from the transmitted and received RF signal.

5. The sound source signal processing apparatus according to claim 3, wherein the position detection unit comprises an ultrasonic transmitter configured to transmit an ultrasonic signal and an ultrasonic receiver configured to receive the transmitted ultrasonic signal, and wherein the position detection unit is configured to detect the relative position from the transmitted and received ultrasonic signal.

6. The sound source signal processing apparatus according to claim 3, wherein the position detection unit comprises an infrared transmitter configured to transmit an infrared signal and an infrared receiver configured to receive the transmitted infrared signal, and wherein the position detection unit is configured to detect the relative position from the transmitted and received infrared signal.

7. The sound source signal processing apparatus according to claim 3, further comprising:

a controller;

wherein the controller is configured to control the position detection unit to be periodically driven to acquire the relative position between the first sound source detection unit and the single microphone of the second sound source detection unit during the beamforming.

8. The sound source signal processing apparatus according to claim 1, further comprising:

a sound pressure detection unit configured to detect sound pressure of the sound source signal; and a controller configured to determine whether a voice signal is contained in the sound source signal by comparing a level of the detected sound pressure of the sound source signal with a reference sound pressure level, and configured to control the sound source signal to be beamformed upon determining that the voice signal is contained in the sound source signal.

9. The sound source signal processing apparatus according to claim 1, further comprising:

a direction input unit configured to allow a user to input direction information during the beamforming;

wherein the beamforming unit is configured to beamform the sound source signal reflecting the direction information input by the user.

10. The sound source signal processing apparatus according to claim 1, wherein a physical location of the first sound source detection unit is independent of a physical location of the single microphone of the second sound source detection unit.

11. A sound source signal processing method, comprising:

detecting sound source signals from different positions through a first sound source detection unit, and a second sound source detection unit that includes a single microphone; and beamforming the sound source signals based on a relative position between the first sound source detection unit and the single microphone of the second sound source detection unit;

wherein the relative position comprises a distance and angle between a center of the first sound source detection unit and the single microphone of the second sound source detection unit.

12. The sound source signal processing method according to claim 11, wherein the beamforming of the sound source signals comprises:

reflecting a weight in each of the sound source signals detected at the different positions and performing fast Fourier transform (FFT) with respect to the weighted sound source signals;

summing the sound source signals with respect to which the FFT has been performed; and performing inverse FFT with respect to the summed signals.

13. The sound source signal processing method according to claim 11, wherein the relative position between the first sound source detection unit and the single microphone of the second sound source detection unit is preset.

14. The sound source signal processing method according to claim 11, further comprising:

transmitting a position signal through a transmitter installed adjacent to the single microphone of the second sound source detection unit upon detection of the sound source signals;

receiving the position signal through a receiver installed adjacent to the first sound source detection unit; and acquiring the relative position between the sound source signals detected at the different positions based on the received position signal.

15. The sound source signal processing method according to claim 14, wherein the position signal comprises an ultrasonic signal or an RF signal.

16. The sound source signal processing method according to claim 11, further comprising:

transmitting a position signal through a transmitter installed adjacent to the first sound source detection unit upon detection of the sound source signals;

receiving the position signal through a receiver installed adjacent to the single microphone of the second sound source detection unit; and acquiring the relative position between the sound source signals detected at the different positions based on the received position signal.

17. The sound source signal processing method according to claim 16, wherein the position signal comprises an ultrasonic signal or an RF signal.

18. The sound source signal processing method according to claim 11, wherein the beamforming of the sound source signals comprises beamforming the sound source signals based on direction information input by a user.

19. The sound source signal processing method according to claim 11, further comprising:

detecting a sound pressure level of each of the sound source signals;

comparing the detected sound pressure level with a reference sound pressure level;

determining that a voice signal is contained in each of the sound source signals when the detected sound pressure level is equal to or greater than the reference sound pressure level; and beamforming the sound source signals upon determining that the voice signal is contained in each of the sound source signals.

20. The sound source signal processing method according to claim 11, wherein the beamforming of the sound source signals comprises:

confirming a frequency of each of the sound source signals;

determining whether a voice signal is contained in each of the sound source signals based on the confirmed frequency; and beamforming the sound source signals upon determining that the voice signal is contained in each of the sound source signals.

21. An apparatus, comprising:

an array of microphones configured to detect a sound source signal;

a single microphone, separate from the array, configured to detect the sound source signal; and a beamforming unit configured to beamform the sound source signal detected by the array and the sound source signal detected by the single microphone based on a relative position between the array and the single microphone;

wherein the relative position comprises a distance and angle between a center of the array and the single microphone.

22. The apparatus according to claim 21, wherein the array is enclosed in an enclosure, and wherein the single microphone is outside of the enclosure.

23. The apparatus according to claim 21, wherein a physical location of the array is independent of a physical location of the single microphone.

* * * * *